US006026590A

United States Patent [19]

Picozza et al.

[11] Patent Number: 6,026,590

[45] Date of Patent: Feb. 22, 2000

[54] HAIR DRYER WITH NIGHT LIGHT

[75] Inventors: Augusto A. Picozza, Crystal Lake, Ill.; W. Dane Starr, Hattiesburg, Miss.

[73] Assignee: Sunbeam Products, Inc.

[21] Appl. No.: 09/113,531

[22] Filed: Jul. 10, 1998

[51] Int. Cl.[7] ..... F26B 19/00

[52] U.S. Cl. ..... 34/90; 34/97

[58] Field of Search ..... 34/90, 96, 97, 34/98, 99, 100; 368/10, 12, 67, 278; D26/26, 51, 54; D32/59; 219/483, 487, 502, 506; 392/380, 384; 132/229, 230

[56] References Cited

U.S. PATENT DOCUMENTS

| | | | |
|---|---|---|---|
| D. 372,189 | 7/1996 | Andis et al. . | |
| 3,610,881 | 10/1971 | Stewart | 392/380 |
| 4,514,618 | 4/1985 | Majthan et al. | 392/379 |
| 4,979,308 | 12/1990 | Moore . | |
| 5,351,417 | 10/1994 | Rubin . | |
| 5,434,386 | 7/1995 | Glenn et al. . | |
| 5,568,691 | 10/1996 | Rubin . | |
| 5,638,339 | 6/1997 | DeLoretto et al. . | |
| 5,823,869 | 10/1998 | Paturzo | 34/90 |

FOREIGN PATENT DOCUMENTS

| | | |
|---|---|---|
| 0801263A2 | 10/1997 | European Pat. Off. . |

*Primary Examiner*—Stephen Gravini
*Attorney, Agent, or Firm*—Kramer Levin Naftalis & Frankel LLP

[57] ABSTRACT

A hair dryer assembly having a night light is comprised of a housing configured to be hand-held. A motor and heating coils are carried within the housing. A light source is disposed on the housing. A circuit provides electrical power to the motor, heating coils, and light.

9 Claims, 6 Drawing Sheets

HAIR DRYER WITH NIGHT LIGHT

FIELD OF THE INVENTION

This invention relates generally to the field of hair dryers, and more specifically to hand-held type hair dryers.

BACKGROUND AND PRIOR ART

It is common to deliberately leave a light illuminating the hallway or bathroom at night, particularly to aid guests or children who may have difficulty navigating in the darkness. Small night lights are often preferred, but leaving a larger light on is also an alternative. In particular, guests in hotel rooms often turn on the bathroom light and leave the door partly open to provide low-level lighting in the dark. The excessive light in the bathroom can be blinding for guests who enter after having been in the dark, and it also increases energy-related costs.

Efforts have been directed toward providing household appliances with multiple functions, including those incorporating a night light. A combination of a bathroom clock and light is disclosed in U.S. Pat. No. 5,638,339 issued to DeLoretto, et al. An appliance combining a can opener and night light is disclosed in U.S. Pat. No. 4,969,308 issued to Moore. An electric circuit having a heater element and a night light, for use with heaters and humidifiers, is disclosed in U.S. Pat. No. 5,434,386 issued to Glenn, et al. A hair dryer apparatus adapted for multi-functional usage is disclosed in U.S. Pat. Nos. 5,351,417 and 5,568,691, both issued to Rubin. The multi-functional usages described in the patents to Rubin relate to the incorporation of accessories into the base of the hair dryer, which include shaver sockets, air fresheners, mirrors, radios, and television monitors.

Nonetheless, the need exists for an appliance that serves the dual purposes of providing a hand-held drying apparatus and/or low-level light at night, for illumination of the bathroom area in the dark.

SUMMARY OF THE INVENTION

The present invention is directed to a dryer apparatus having a night light. The apparatus is comprised of a housing configured to be hand-held. A motor and heating coils are carried within the housing. The motor and heating coils are arranged such that when the motor is activated, air is forced through the coils to thereby heat the air. A light source is carried on the housing. A circuit for supplying power to the motor and the light source is also provided.

The preferred embodiment of the present invention provides a dual-purpose bathroom appliance which may function as a hair dryer and a night light. The preferred embodiment also provides for an the electric circuit for the night light having light-responsive capabilities, so that the night light is energized or deactivated when the room is darkened or illuminated. The invention also provides for an embodiment in which the hand-held portion of the hair dryer may be mounted on a base or holder, for attaching to a wall or other surface.

The safety and utility achieved by providing an appliance with these two functions benefits both household and commercial users. The low-level light facilitates access to and movement in the bathroom in the dark, without compromising night vision. By housing the night light in the hair dryer appliance, no additional electrical outlet is needed for the night light. Use of the night light conserves energy and enables safe movement in the dark. These and other advantages and benefits will become apparent from the Description of the Preferred Embodiments herein below.

BRIEF DESCRIPTION OF THE DRAWINGS

For the present invention to be easily understood and readily practiced, the present invention will be described for purposes of illustration, and not limitation, in conjunction with the following figures, wherein.

DETAILED DESCRIPTION OF THE PREFERRED EMBODIMENTS

Figure 1:
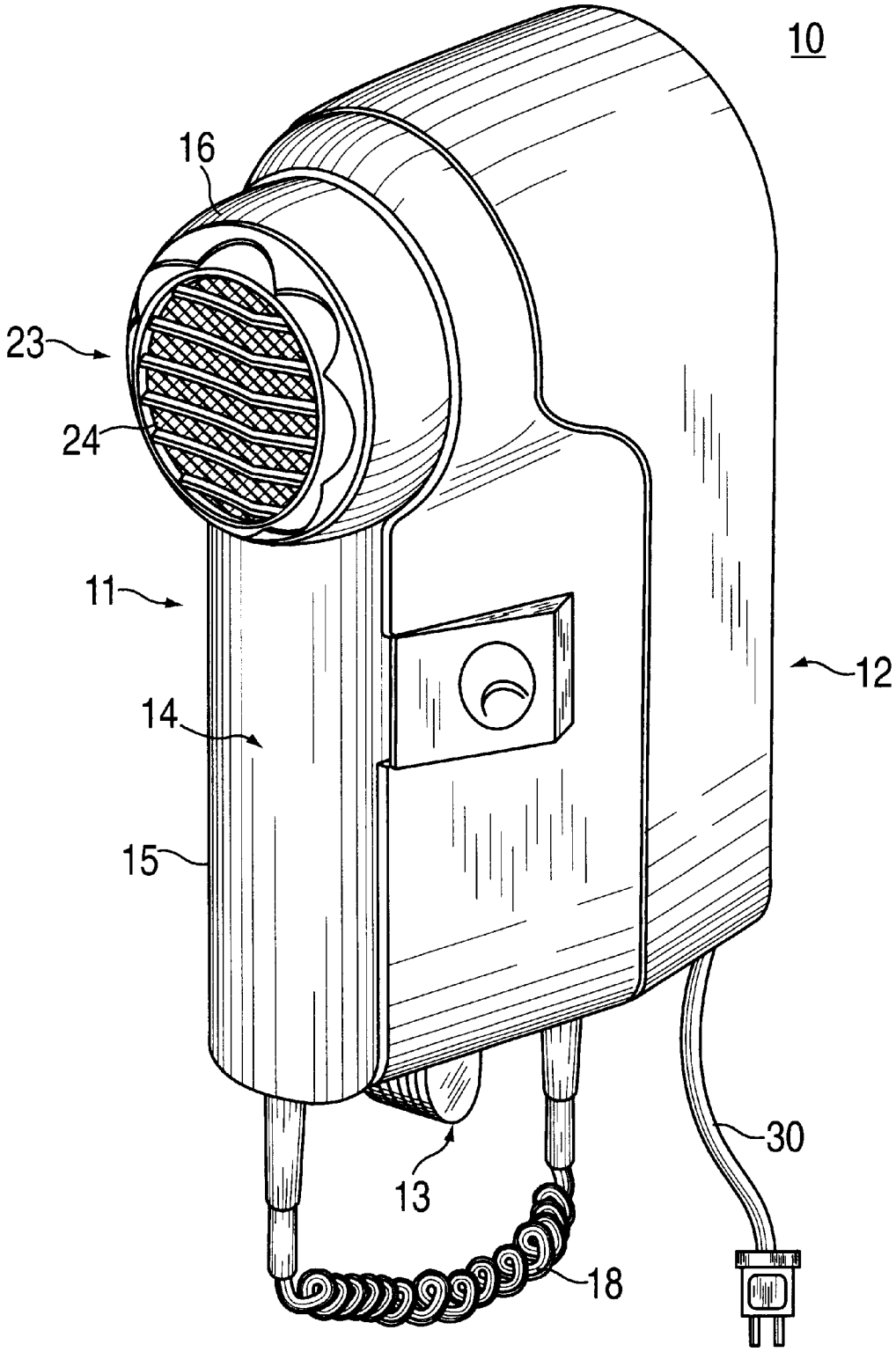
FIG. 1 is a perspective view of a preferred embodiment of a hair dryer apparatus constructed according to the teachings of the present the invention.

As shown in FIG. 1, a preferred embodiment of the hair dryer apparatus 10 of the present invention includes a hand-held hair dryer assembly 11 and a base 12 for receiving the hair dryer assembly 11. The embodiment in FIG. 1 includes a night light 13 attached to the base 12.

Figure 2:
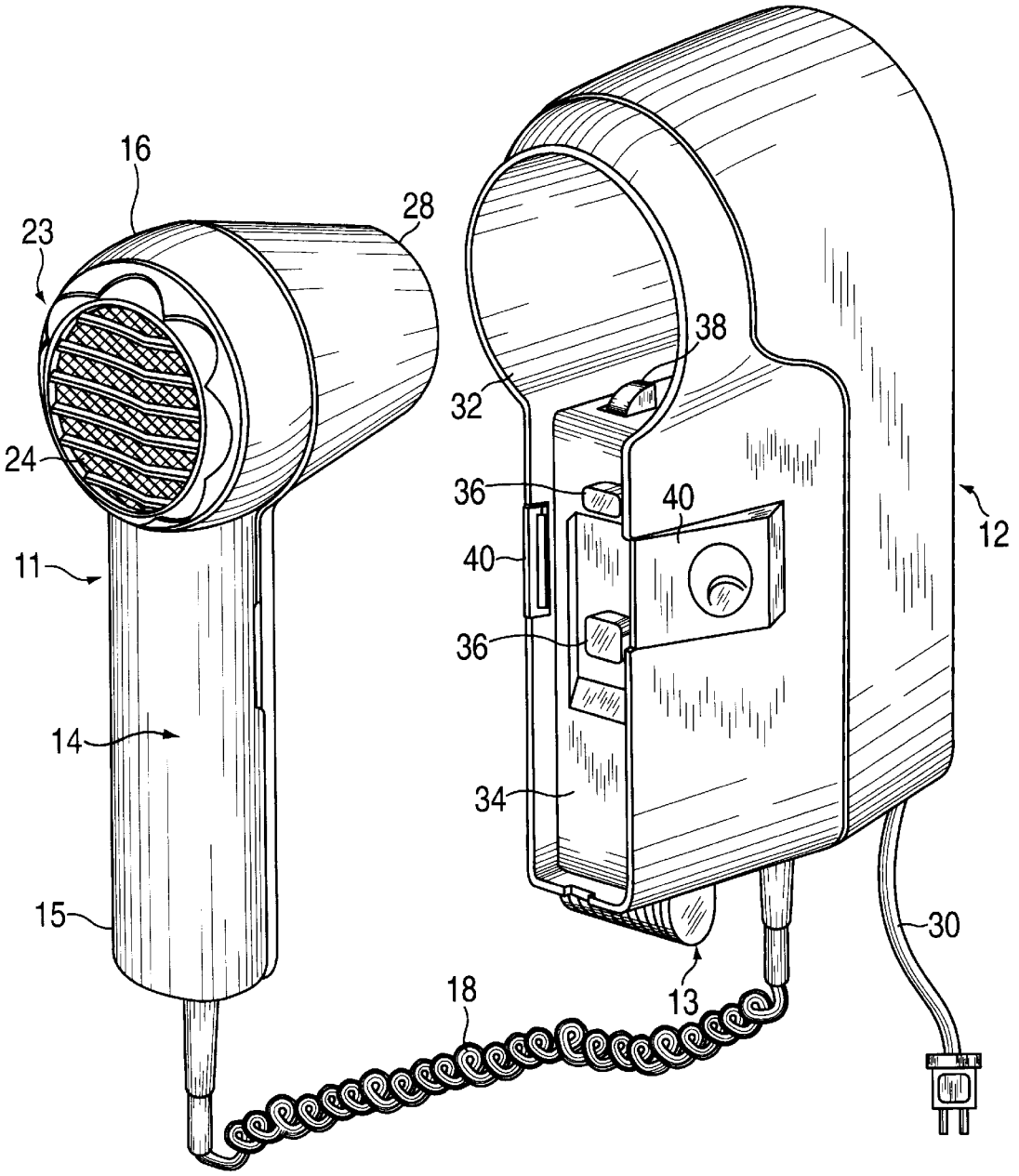
FIG. 2 is another perspective view illustrating the hand-held hair dryer of FIG. 1 with the hand-held portion removed from the base.
Figure 5:
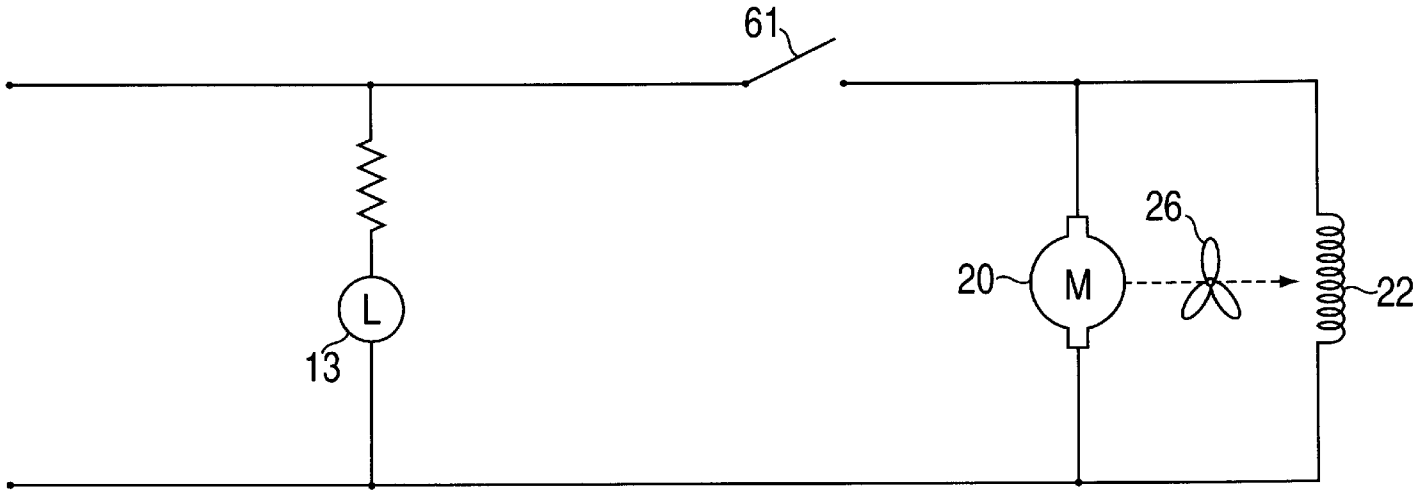
FIG. 5 is a diagram of the electrical connections between the components of the hair dryer apparatus, illustrating an embodiment in which the night light is continuously turned "on" when the power is connected.

The hand-held hair dryer assembly 11 in FIG. 1 is comprised of a housing 14 configured to be hand-held. The housing 14 has a handle portion 15, a dryer head 16 at the 15 top end of the handle portion 15, and a power cord 18 extending from the bottom end of the handle portion 15. As is conventional, a motor 20, shown in FIG. 5, and heating coils 22, also shown in FIG. 5, are carried in the generally cylindrically-shaped head 16 of the dryer assembly 11. The coils 22 are located proximate to a fan 26, such that when the motor 20 is energized, the fan forces air through the coils 22 to thereby become heated. The dryer head 16 has at one end an air intake 23, covered by a grille 24, as seen in FIG. 1. As shown in FIG. 2, an end opposite the intake 23 acts as a discharge outlet 28 for the heated air.

As shown in the embodiment of FIGS. 1 and 2, the power coil 18 extends from the bottom of the handle portion 15 and conducts electrical energy from the base 12 to the motor 20 in the dryer head 16. A second power cord 30 extends from the lower end of the base 12 to a power outlet (not shown).

As shown in FIG. 2, the base 12 is generally oval-shaped and configured to removably receive the hand-held hair dryer assembly 11. A top portion of the base receives the dryer head 16 into a cup-like socket 32 while the central and bottom portions of the base receive the dryer's handle portion 15 into a handle-shaped channel 34. The handle-shaped channel 34 contains control buttons 36 which are operable when the hand-held dryer assembly 11 is removed from the base 12. The control buttons 36 direct electrical energy received from the second power cord 30 to a circuit located in the base 12 through the power cord 18, to the hand-held hair dryer assembly 11 to activate the motor 20, thereby causing the fan 26 to rotate, and heating coils 22, shown in FIGS. 5–8. Alternatively, as shown in FIGS. 7 and 8, one or more of the control buttons 36 may control the "on" or "off" activation, or the intensity level, of the night light 13.

As shown in FIG. 2, a latch 38 is positioned at the perimeter of the cup-like socket 32 for releasably engaging the dryer head 16 of the hand-held hair dryer assembly 11. A pair of release levers 40 positioned on the surface of the base 12 are disposed on opposing sides of the handle-shaped channel 34. When pressed, the release levers 40 disengage the latch 38 from the dryer head 16 to allow a user remove the mounted hand-held hair dryer assembly 11 from the base 12.

Figure 3:
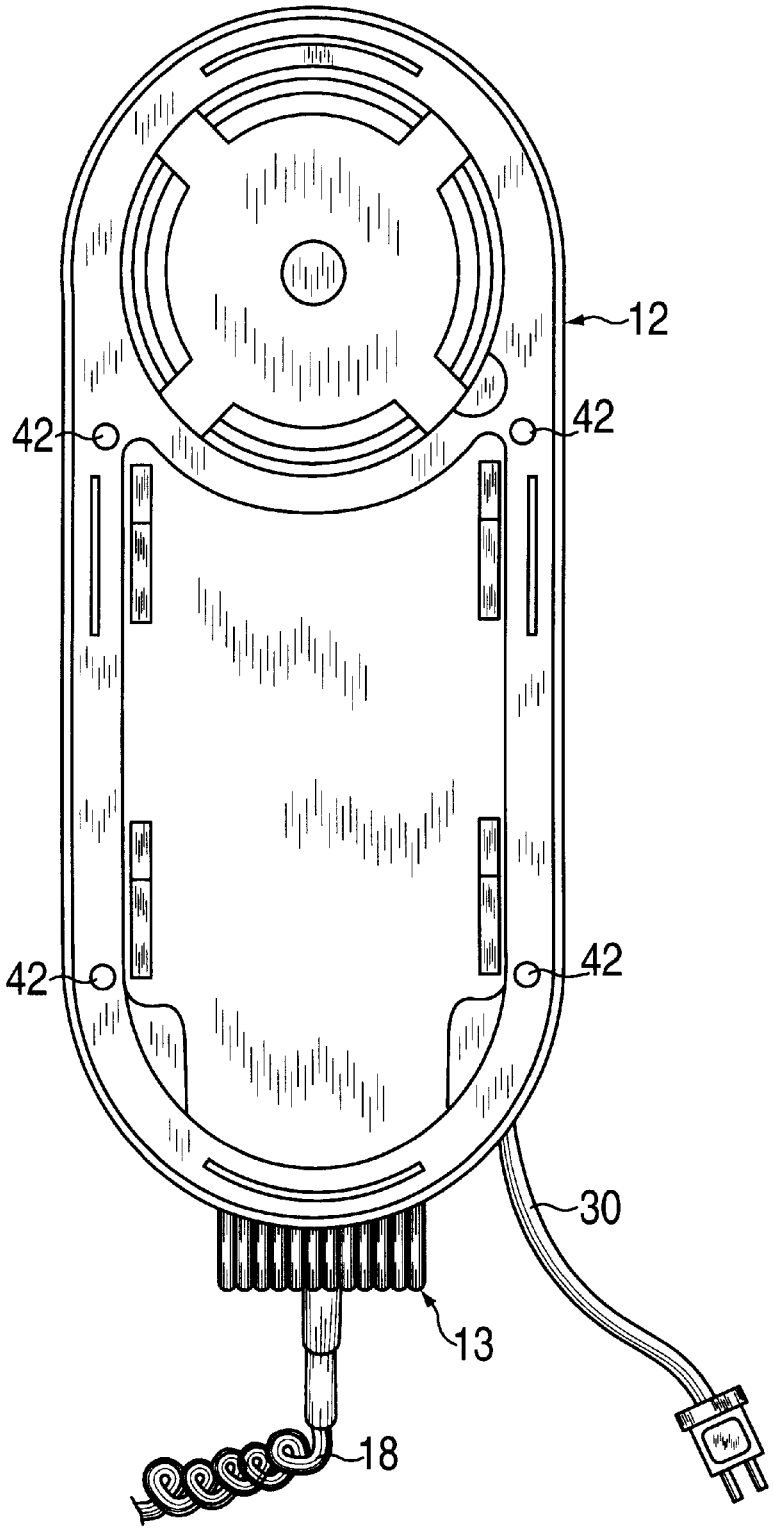
FIG. 3 is a view of the rear of the base of the embodiment of the hair dryer apparatus of FIG. 1.

FIG. 3 illustrates a rear view of the base 12 which is generally oval-shaped. The rear of the base 12 is relatively planar to enable it to be mounted to a surface, such as a wall. Small openings 42 are positioned in the base 12 to allow screws to be placed for long-term mounting. Other means for mounting the base 12 to a particular surface may include using adhesives or suction cups.

Figure 4:
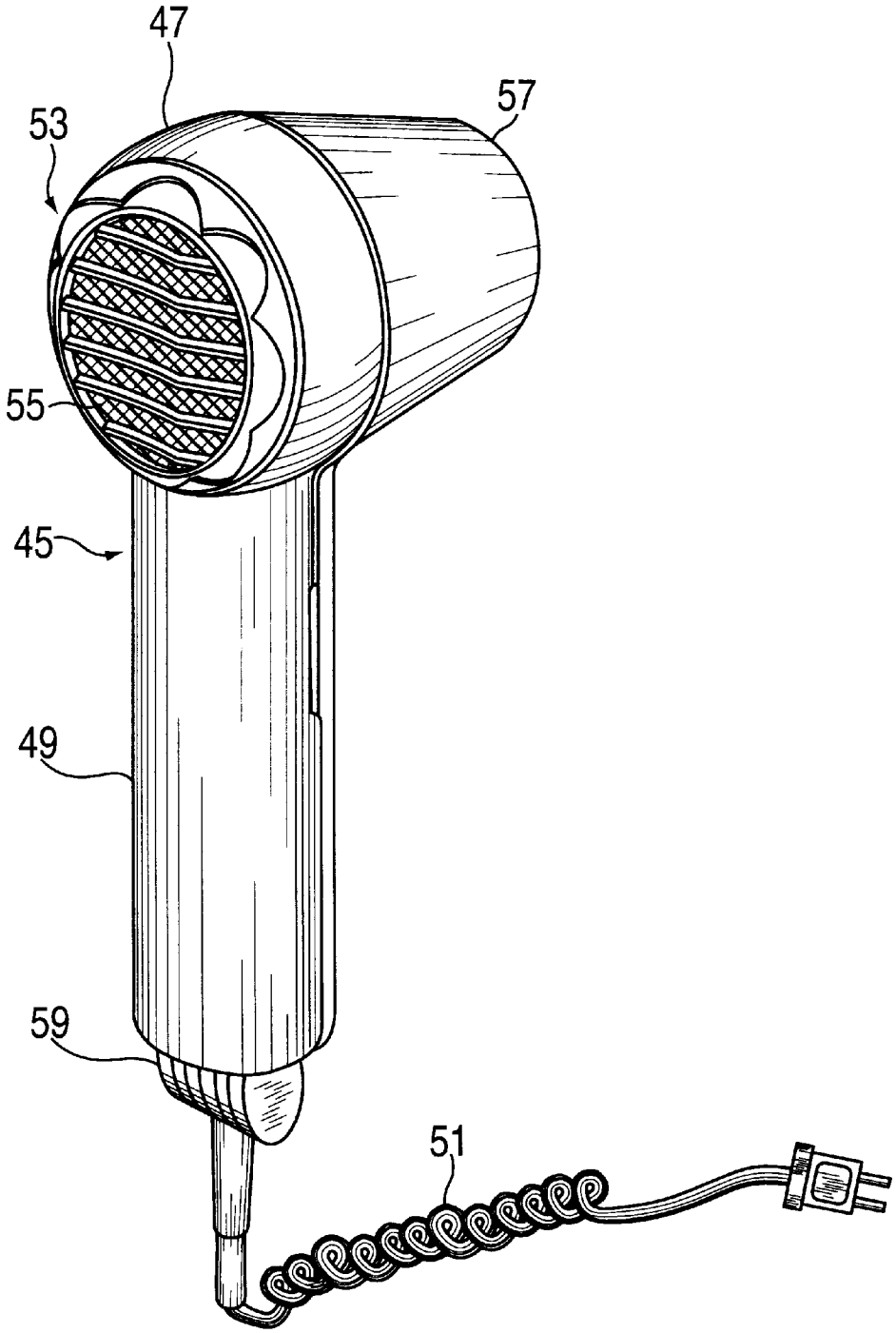
FIG. 4 is a perspective view of an embodiment of a hair dryer apparatus having a night light directly on the housing of the hand-held hair dryer.

As shown in FIG. 4, another embodiment of the hand-held hair dryer apparatus is comprised of a housing 45 configured to be hand-held, and having a generally cylindrically-shaped head 47 carried on the top end of an elongated handle portion 49. A power cord 51 extends from the bottom end of the handle portion 49. In the embodiment shown in FIG. 4, the power cord 51 connects directly to a power outlet (not shown).

As is conventional, a motor 20, carrying a fan, and heating coils 22 shown in FIG. 5 are carried in the generally cylindrically-shaped head 47. As described above, the coils 22 are proximate to the fan 26 such that activation of the motor causes air forced through the coils to become heated. The dryer head 47 has at one end an air intake 53 covered by a grille 55 and, at the opposite end an air discharge outlet 57. In the embodiment of FIG. 4, a night light 59 is mounted directly on the housing 45 of the hand-held hair dryer, at the bottom of the handle portion 49. The night light 59 may be energized by the electricity from the power cord 51 as shown in any of the embodiments of FIGS. 5–8.

Figure 6:
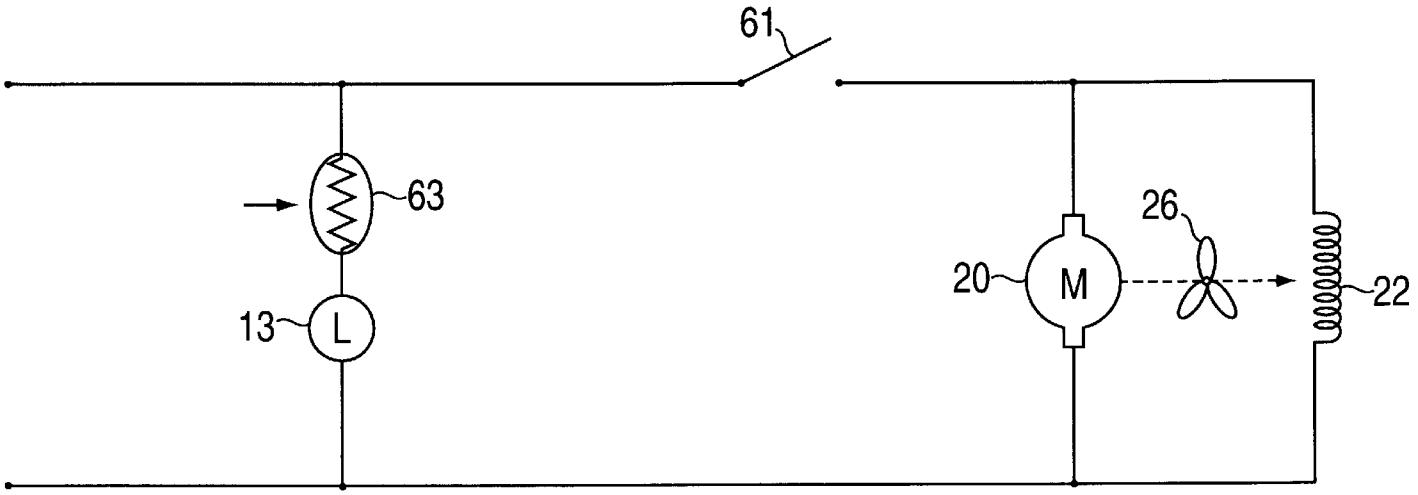
FIG. 6 is a diagram of the electrical connections between the components of the hair dryer apparatus, illustrating an embodiment in which the night light is turned on when the light detector detects low ambient light levels.
Figure 7:
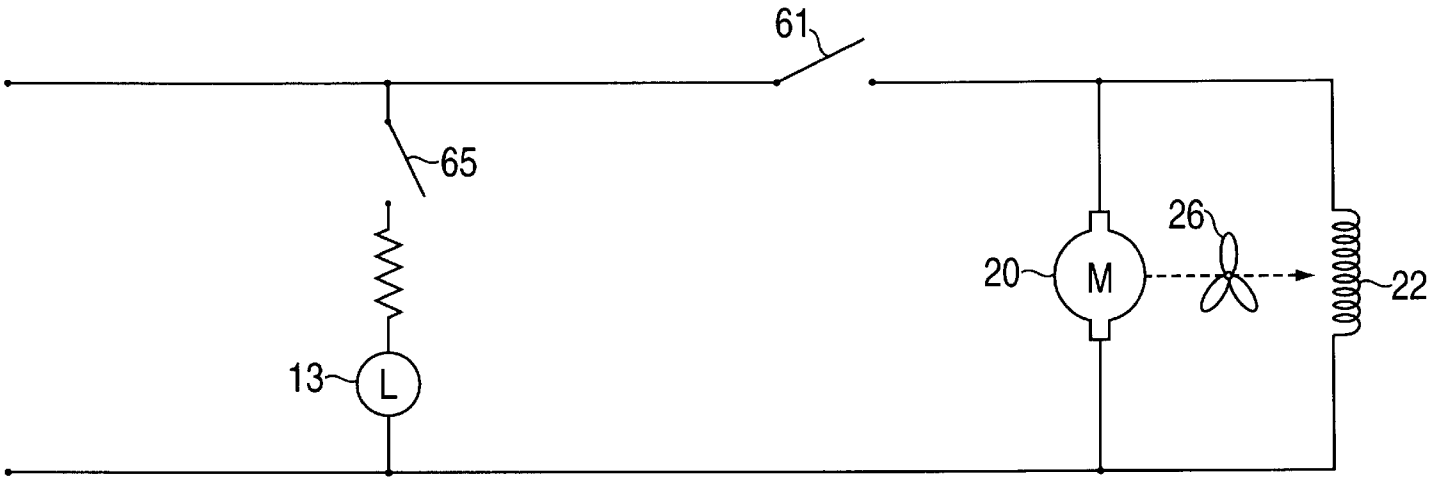
FIG. 7 is a diagram of the electrical connections between the components of the hair dryer apparatus, illustrating the embodiment in which the night light may be switched "on" or "off" independently of the dryer.
Figure 8:
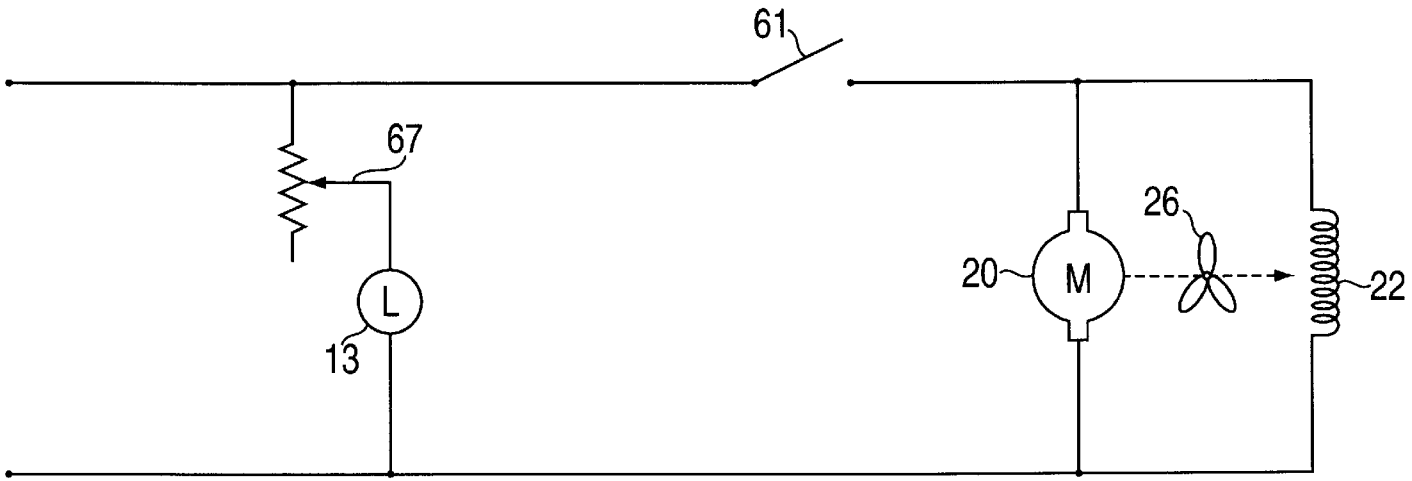
FIG. 8 is a diagram of the electrical connections between the components of the hair dryer apparatus, illustrating the embodiment in which the intensity of the night light may be adjusted.

Schematic diagrams showing the relationships and the electrical connections among the components of the hair dryer apparatus of the present invention are given by FIGS. 5–8. In FIG. 5, the night light 13 is supplied with continuous electricity when the power source is connected, and the motor 20 and heating coils 22 are operated by a control switch 61, which may be operated by control buttons 36 shown in FIG. 2. In FIG. 6, the night light 13 is illuminated or extinguished through the control of a light-sensitive device 63. When low levels of ambient light are detected, current is permitted to flow through the light 13. In FIG. 7, the night light 13 is illuminated or extinguished by a second control switch 65. In FIG. 8, the intensity of the night light 13 is adjustable through a rheostat control 67.

While the present invention has been described in connection with preferred embodiments thereof, many variations will be apparent to those of ordinary sill in the art. For example, switches may be placed on the hand-held hair dryer assembly, base assembly, or both. Many different circuit configurations are possible depending upon the components used. For example, the circuit for supplying power may be a circuit for supplying AC power to the motor and light and DC power to the coils, DC power to the motor and light and AC power to the coils, etc. It is intended that any circuit capable of supplying the power necessary for the type of components chosen falls within the scope of the claims. Other embodiments with different configurations for the base, latch and release levers are also possible. All such variations are considered to be covered in the following claims.

We claim:

1. A hand-held hair dryer apparatus having a night light, comprising:

a housing configured to be hand-held;

air-blowing motor carried within said housing;

heating coils carried within said housing proximate to said motor such that said motor, when actuated, forces air through said coils to thereby heat the air;

a source of light carried on said housing; and a circuit for supplying power to said motor and said light source.

2. The hand-held hair dryer apparatus of claim 1, wherein said circuit is carried within said housing.

3. The hand-held hair dryer apparatus of claim 1, further comprising a base adapted to removably receive said housing.

4. The hand-held hair dryer apparatus of claim 3, wherein said base is further adapted to be mounted to a wall.

5. The hand-held hair dryer apparatus of claim 3, wherein said circuit is carried within said base.

6. The hand-held hair dryer apparatus of claim 3, additionally comprising a latch for engaging said hand-held housing when said housing is received by said base.

7. The hand-held hair dryer apparatus of claim 1, further comprising a light-responsive control for operating the light source in response to the intensity of ambient light.

8. The hand-held hair dryer apparatus of claim 1, further comprising a rheostat in said circuit for light intensity control.

9. A hand-held hair dryer apparatus having a night light, comprising:

a housing configured to be hand-held;

an air-blowing motor carried within said housing;

heating coils carried within said housing proximate to said motor such that said motor, when actuated, forces air through said coils to thereby heat the air;

a base adapted to removably receive said housing;

a source of light carried on said base; and at least one circuit for supplying power to said motor and said light source.

* * * * *